US010106945B2

(12) United States Patent
Waters, Jr.

(10) Patent No.: US 10,106,945 B2
(45) Date of Patent: Oct. 23, 2018

(54) FLOOD PROTECTION FOR UNDERGROUND AIR VENTS

(71) Applicant: Louis A. Waters, Jr., Houston, TX (US)

(72) Inventor: Louis A. Waters, Jr., Houston, TX (US)

(73) Assignee: Floodbreak, L.L.C., Houston, TX (US)

( * ) Notice: Subject to any disclaimer, the term of this patent is extended or adjusted under 35 U.S.C. 154(b) by 0 days.

(21) Appl. No.: 15/789,537

(22) Filed: Oct. 20, 2017

(65) Prior Publication Data

US 2018/0112370 A1 Apr. 26, 2018

Related U.S. Application Data

(60) Provisional application No. 62/411,344, filed on Oct. 21, 2016.

(51) Int. Cl.

| | |
|---|---|
| ***E02D 19/02*** | (2006.01) |
| ***E21F 1/08*** | (2006.01) |
| ***E06B 3/38*** | (2006.01) |
| ***F24F 13/14*** | (2006.01) |
| ***E05F 11/16*** | (2006.01) |

(52) U.S. Cl.

CPC ..... *E02D 19/02* (2013.01); *E05F 11/16* (2013.01); *E06B 3/38* (2013.01); *E21F 1/08* (2013.01); *F24F 13/1413* (2013.01); *F24F 13/1426* (2013.01); *E05Y 2900/60* (2013.01); *F24F 2221/52* (2013.01)

(58) Field of Classification Search

CPC combination set(s) only.

See application file for complete search history.

(56) References Cited

U.S. PATENT DOCUMENTS

| | | | | |
|---|---|---|---|---|
| 4,832,527 | A | 5/1989 | Bachman | |
| 5,210,685 | A | 4/1993 | Raisanen | |
| 6,217,756 | B1 | 4/2001 | Martinez | |
| 6,726,402 | B1 | 4/2004 | Martinez | |
| 7,648,310 | B2 * | 1/2010 | Lee | E03F 1/00 405/36 |
| 8,033,753 | B2 | 10/2011 | Waters, Jr. | |
| 9,004,814 | B2 | 4/2015 | Petrillo | |

(Continued)

OTHER PUBLICATIONS

Search History, International Search Report, and Written Opinion of International Searching Authority in PCT/US2017/0057629, all dated Jan. 17, 2018.

*Primary Examiner* — Kyle Armstrong

(74) *Attorney, Agent, or Firm* — Tim L. Burgess, P.C.

(57) ABSTRACT

Apparatus for allowing ventilation for underground tunnels through a ventilation shaft opening to atmosphere yet preventing underground flooding from surface waters pouring through the grate comprises an assembly that fits within the ventilation shaft and includes one or more panels mounted on a pivot axis and rotatable upwardly by human action raising the panel past a center point of the pivot axis to an upright inwardly leaning home position that allows ventilation as usual but by manual push or pull of the panels past the center point of the pivot axis lets the panels rotationally fall under gravitational impetus to a lower sealing position closing a passage between the ventilation shaft and atmosphere to prevent water from entering the underground tunnels.

20 Claims, 7 Drawing Sheets

(56) References Cited

U.S. PATENT DOCUMENTS

| | | | | |
|---|---|---|---|---|
| 9,670,697 | B2 * | 6/2017 | Takahashi | E05B 65/1026 |
| 2004/0266329 | A1 | 12/2004 | Kennedy et al. | |
| 2007/0215212 | A1 | 9/2007 | Demeniuk | |
| 2016/0076268 | A1 | 3/2016 | Waters, Jr. | |
| 2016/0097212 | A1 | 4/2016 | Waters, Jr. | |

* cited by examiner

FLOOD PROTECTION FOR UNDERGROUND AIR VENTS

CROSS REFERENCE TO RELATED APPLICATION

This application claims the priority benefit of U.S. Provisional Application No. 62/411,344 filed Oct. 21, 2016, the disclosures of which are incorporated herein by reference.

STATEMENT REGARDING FEDERALLY SPONSORED RESEARCH AND DEVELOPMENT

Not applicable

BACKGROUND OF THE DISCLOSURE

Technical Field

This invention relates to blocking flooding water from entering underground ventilation passages.

Background Art

Surface storm waters entering and flooding underground tunnels and chambers through ventilation ducts connecting the underground chambers or tunnels to air at ground surface affect without limitation, underground transportation tunnels for road vehicles, trains, and subways, and underground chambers, such as associated with a complex of connecting tunnels and shafts, for example as used for such things as underground hydroelectric-power plants, or with underground utilities which require ventilation, such as underground transformer rooms.

In a typical subway ventilation arrangement, ventilation ducts or shafts are incorporated into subway systems near stations to exhaust stale pushed air as the train nears a station and to pull in fresh outside air as a train leaves a station, Also reducing the "piston effect" of air being forced through the tunnels at high speeds by moving trains. Typically, a ventilation duct communicates from an underground tunnel and terminates in a ventilation shaft structure below grade level that opens to the atmosphere at grade level such as a sidewalk where the opening is covered by a subway grating.

Subways have systems for handling water. When it rains, water runs down stairwells, onto platforms and thence onto tracks, and some gets in the ventilation systems through the surface grates. Drains beneath the tracks pipe water to underground sumps in pump rooms next to the subway tracks. Pumps deliver the water up to pressure relief manholes open to the atmosphere at street level; from there the water drains under gravity flow into city storm sewers. The problem is that in heavy rains, storm sewers are overwhelmed and flush water back into the streets, flooding the streets with water that inundates sidewalks and pours down through subway grates into the ventilation system thence into the tunnels and onto the tracks. The pumping system can only return water to the flooded street; from there the water reenters the flood pool pouring into the ventilation system, defeating the pumping system as a means of controlling subway flooding.

One solution for reducing entrance of runoff water from sidewalk grate openings through the ventilation ducts down into the underground systems was raising the subway ventilation grates above sidewalk level, as was done in some locations in New York City in Manhattan, Queens and Brooklyn after flooding from a severe rainstorm in 2007. This not only was costly to implement but also sacrificed much of the available sidewalk area available for pedestrians. Storm surge flooding is also a problem. The flooding problem is especially acute in cities like New York and Lower Manhattan, which is low-lying, vulnerable to storm surges and dotted with grade-level grates, stairwells and other points of entry for running water into the subways. In advance of the super storm Sandy in 2013, when predicted storm surge and high tides in addition to heavy rains signaled flooding of subways, workers resorted to sandbags and fastening plywood covers over subway ventilation grates to try to prevent flooding. Sandy was testament to flood hazards of subways and vented subterranean structures. Fastening plywood covers over large numbers of air vent grates in a short period of time as a solution is an imperfect labor and materials intensive process and can be too little too late, as was made clear by subway flooding from Sandy. A simpler, faster, relatively inexpensive and more effective method of preventing flooding through sidewalk air vent gratings is needed.

DETAILED DESCRIPTION OF EMBODIMENTS

Figure 1:
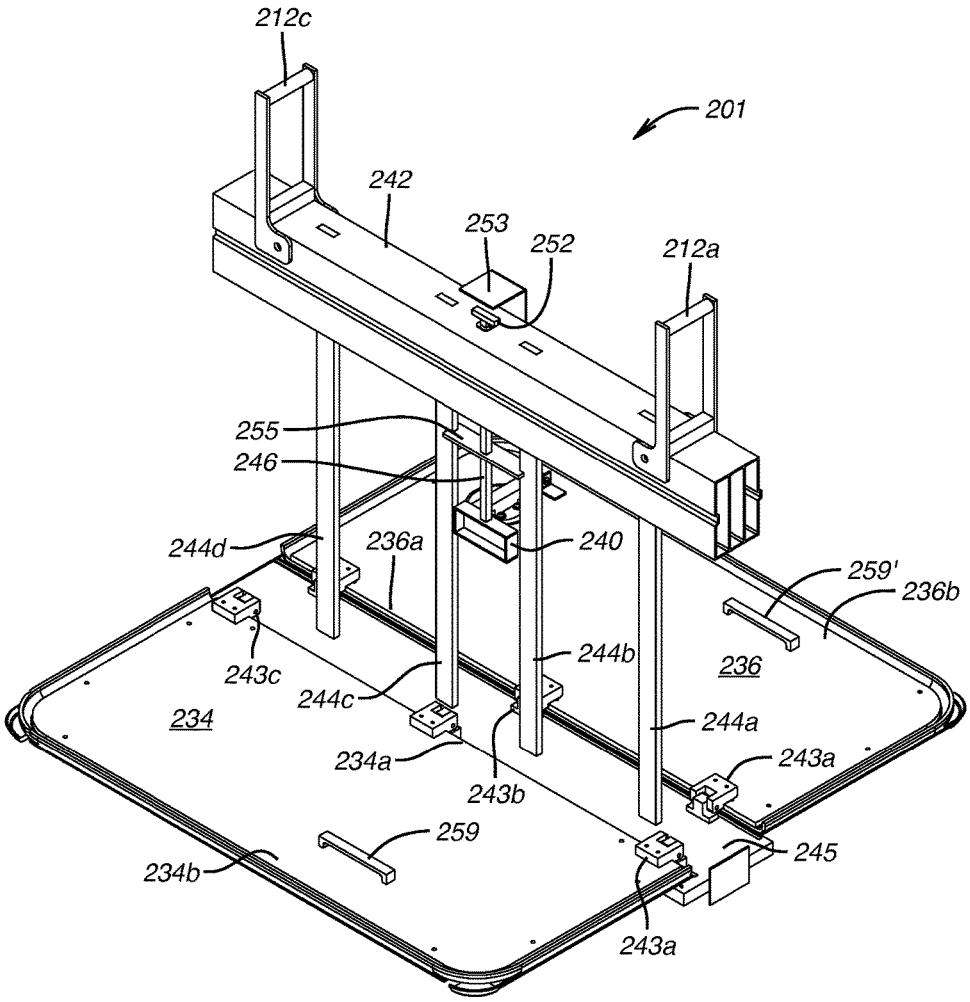
FIG. 1 is an isometric view of an exemplary embodiment of a panel apparatus of this invention employing a pair of panels in which the panels are illustrated in a lowered position.
Figure 2:
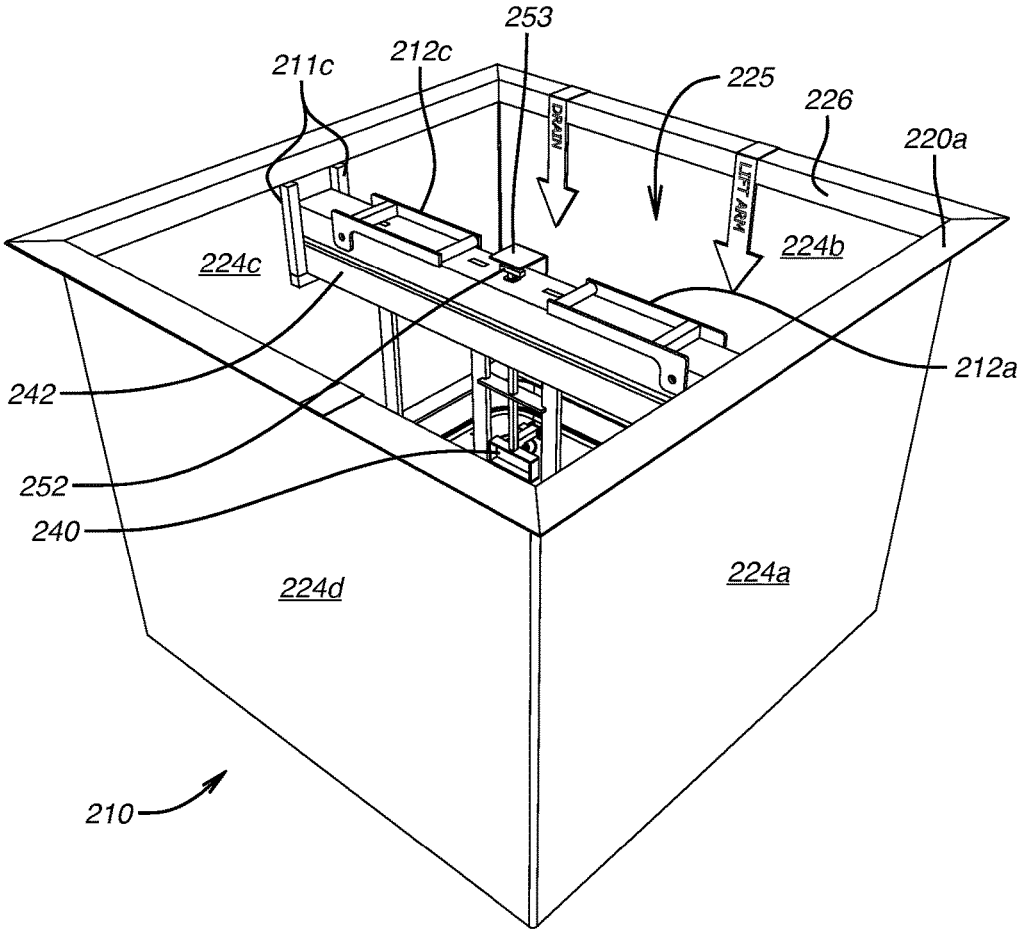
FIG. 2 is an isometric view of an exemplary embodiment of panel apparatus of this invention installed in a support for the panels; the panels are deployed in a lowered ventilation passage closing position.
Figure 3:
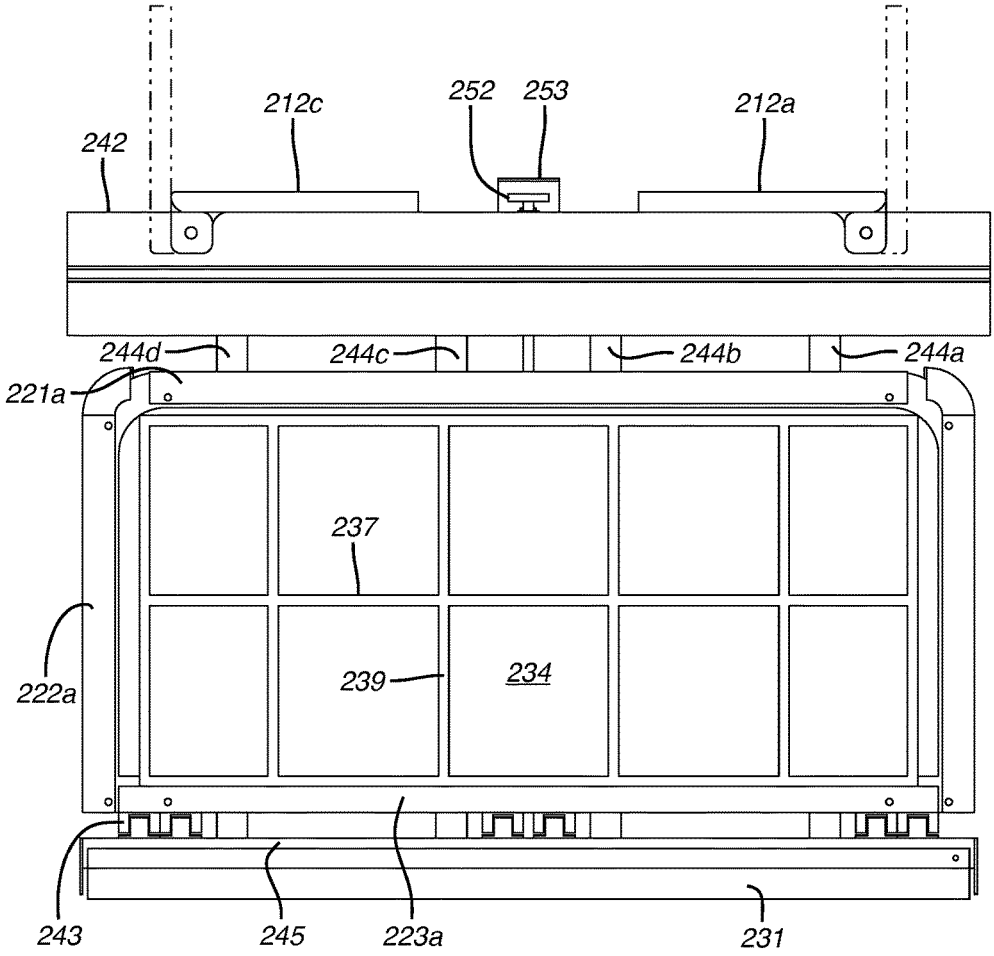
FIG. 3 is a side elevational view of an exemplary embodiment of the panel apparatus of this invention remove from the support of FIG. 2 and illustrated in a raised position.
Figure 5A:
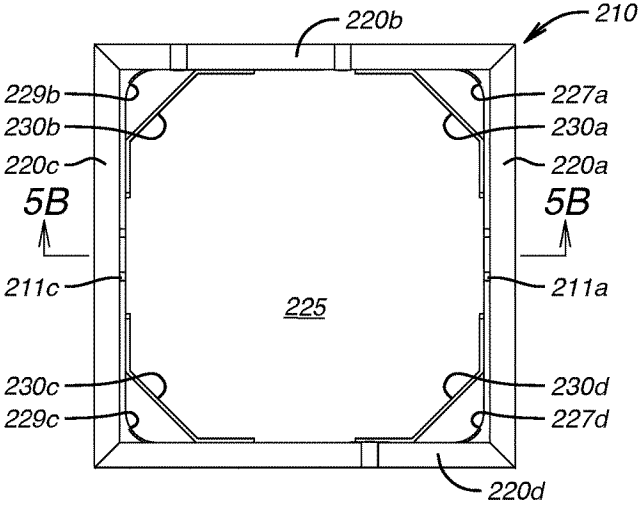
FIG. 5A is a top plan view of FIG. 4.
Figure 5B:
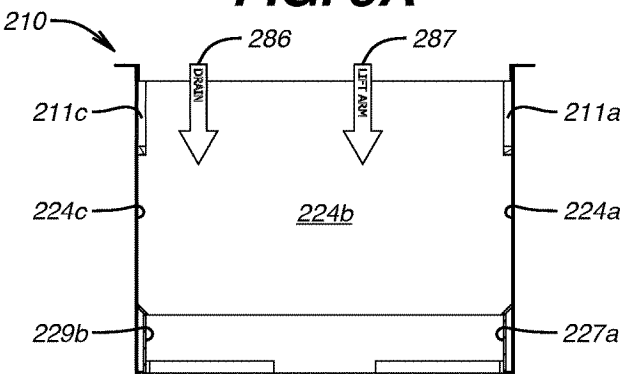
FIG. 5B is a side elevation al view of FIG. 4.
Figure 4:
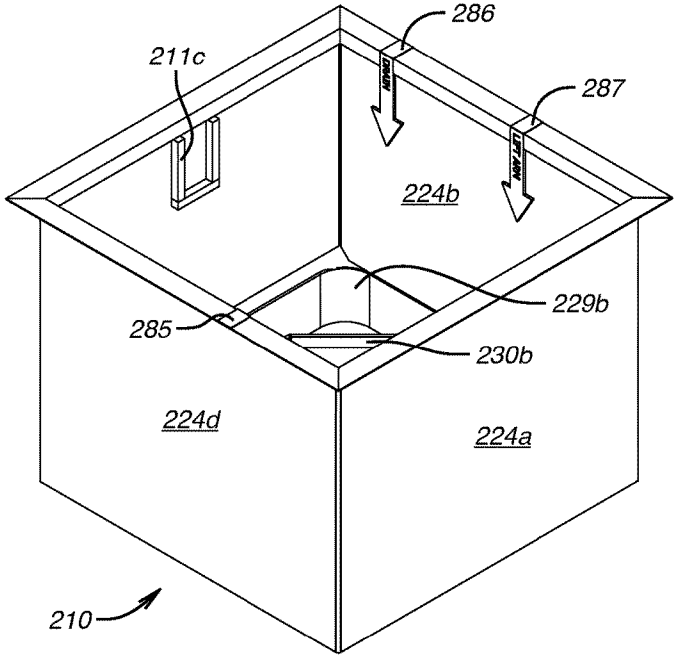
FIG. 4 is an isometric view of the embodiment of FIG. 2 with the panel apparatus of FIGS. 1, 2 and 3 removed.

In accordance with this invention apparatus is provided for allowing ventilation as usual for underground tunnels through a ventilation shaft covered by grating opening to atmosphere, yet when there is advance warning of a serious storm event such as an offshore hurricane or tropical storm predicted to make landfall as was the notorious 2013 super storm Sandy (a "threat of flooding"), the apparatus is manually operable by active human intervention to prevent underground flooding from surface waters pouring through the grating. The concepts embodied in the exemplary embodiments of such apparatus described herein have application to any system in which an atmospheric opening communicates with a ventilation duct for an underground chamber or tunnel or other underground structure requiring ventilation, and through which opening substantial volumes of water can enter, whether by heavy rain or by storm surge propelled by hurricane or tropical storm or otherwise.

In the descriptions of exemplary embodiments of the invention that follow, reference is made to the accompanying drawings, which form a part hereof and in which are shown, by way of illustration, specific embodiments in which the invention may be practiced. The drawings are conceptual in nature to represent the arrangement of elements of the exemplary embodiments; the elements are not necessarily to scale. Specific details disclosed herein are in every case a non-limiting embodiment representing concrete ways in which the concepts of the invention may be practiced. This serves to teach one skilled in the art to employ the present invention in virtually any appropriately detailed system, structure or manner consistent with those concepts. It will be seen that various changes and alternatives to the specific described embodiments and the details of those embodiments may be made within the scope of the invention. Because many varying and different embodiments may be made within the scope of the inventive concepts herein described and in the specific embodiments herein detailed, it is to be understood that the details herein are to be interpreted as illustrative and not as limiting.

For illustrative purposes of an application of the concepts herein disclosed for blocking entrance of water into a ventilation duct, the embodied concepts are described in reference to a specific ventilation environment. The exemplary application is for a subway system. In the specific embodiments described herein as examples, it is assumed the atmospheric opening through which flooding waters enter has a rectilinear shape, as for grated grade level sidewalk openings for subway ventilation systems, which at least in New York City typically are rectangular. Although the descriptions of specific embodiments relate to a rectilinear shape and for a particular environment, the invention does not require that the opening be rectilinear or that embodiments of the invention conform to a rectilinear shape or that the atmospheric opening be at grade level. The elements of the invention can be configured to fit within the downwardly vertically projected dimensions of any ventilation shaft surface opening serving any underground tunnel, chamber, room or other underground structure, whether rectilinear, circular or oval or some other shape.

The various directions such as "upper," "lower," "bottom," "top," "transverse", "perpendicular", "vertical", "horizontal," "outwardly," "inwardly" and so forth used in the detailed description of embodiments are made only with respect to easier explanation in conjunction with the drawings. The components may be oriented differently while performing the same function and accomplishing the same result as the embodiments herein detailed that embody the concepts of the invention, and such terminologies are not to be understood as limiting the concepts which the embodiments exemplify. For example, the term "perpendicular" means substantially at a right angle to a reference to a degree that if not absolutely a right angle will not materially adversely affect the arrangement and function of the element described as perpendicular. The terms "vertical" or "vertically" include but are not limited to literal vertical and generally mean oriented up and down with respect to the earth's horizon to a degree that if not absolutely vertical will not materially adversely affect the function of the element described as vertical. Similarly, the terms "horizontal" or "horizontally" include but are not limited to literal horizontal and generally mean not out of level with respect to the earth's horizon to a degree that will materially adversely affect the function of the element described as horizontal.

As used herein, the use of the word "a" or "an" when used in conjunction with the term "comprising" (or the synonymous "having" or "including") in the claims and/or the specification may mean "one," but it is also consistent with the meaning of "one or more," "at least one," and "one or more than one." In addition, as used herein, the phrase "connected to" means joined to or placed into communication with, either directly or through intermediate components.

The exemplary embodiments described herein comprise an assembly that fits within the ventilation shaft, typically under a grating. In the exemplary embodiments a support is arranged in the ventilation shaft and defines a passage between top and bottom openings of the support for fluid communication of a ventilation duct up through the support to the atmospheric opening of the shaft. Each of one or more panels is mounted on a pivot axis in the support (a) for rotation of each panel upwardly by human action raising each panel past a center point of the pivot axis into an upright inwardly leaning home position in the support, the home position not obstructing the passage between the top and bottom openings of the support to allow ventilation as usual in normal times, and but on threat of flooding, (b) for rotation of each panel downwardly by human action moving each panel away from the inwardly leaning home position outwardly past the pivot or center point of the pivot axis, allowing each panel then to rotationally fall by gravitational impetus to a lower passage closing position where further downward rotation is prevented by one or more stops within and connected to the support proximate the bottom opening of the support. Each panel has a profile that, if one panel alone, or if more than one panel, together, closes the passage when each panel gravitationally rotates to the passage closing position, thereby preventing water from passing into ventilation ducts leading to underground tunnels or chambers. The upright inwardly leaning home position of the one or more panels is sometimes herein called an "over-the-center" position.

In one exemplary embodiment, a single panel is mounted in the home position to a side of such a passage to alone gravitationally fall from home position to a passage closing position across the entirety of the passage to protect the underground ventilation duct from flooding. In another exemplary embodiment, a pair of panels is mounted on opposite sides of the passage, to gravitationally fall from home position down toward each other to passage closing positions to combine to close the passage. In yet another exemplary embodiment, a pair of panels is mounted centrally in the passage for rotation of the panels in directions opposite each other from the home position to a lower passage closing position. An advantage of paired panels is that they may be used to close a passage that is wider than it would be feasible for a single taller panel to close.

A ventilation shaft in which an exemplary embodiment of the invention may be fitted may not be vertical, and so the orientation of the passage of the support may not be vertical but at some angle relative to horizontal that allows the panels to gravitationally rotate under their own weight to a position closing the bottom opening in the support. A large part of the time the shaft in which the support of an exemplary embodiment of this invention is fitted will be vertical, in which case the rotational axis or axes of the panels is horizontal.

In an exemplary embodiment of the invention, the support may be a space frame. In an exemplary embodiment of the invention employing a space frame, the space frame includes flanges configured to extend over a top of walls of the shaft, for suspension of the support in the shaft.

In another exemplary embodiment of the invention, the support is a liner wall, sized to internally line the shaft between the ventilation duct and the atmospheric opening. In an exemplary embodiment of the invention employing a liner wall, the liner wall is supported in the shaft from a frame having flanges transverse to the liner wall to extend over a top of walls of the shaft.

In an exemplary embodiment for application in a vertical ventilation shaft where the atmospheric opening is rectilinear, the support of the apparatus may comprise a four-sided box inclusive of sidewalls sized to internally fit in the vertical shaft between a ventilation duct and the atmospheric opening. Such support has flanges transverse to said sidewalls for overlaying a top of the vertical shaft to hold the support box in said shaft. In an exemplary box embodiment sidewalls adjacent one another may include a base having rounded corners with a first radius of curvature and distal portions of the supported rotatable panels have rounded corners with a radius of curvature substantially the same as said first radius of curvature of the sidewall corners they sweep when rotating to the passage closing position. In an exemplary embodiment, the panels include seals for sealing the passage when the panels are in the passage closing position.

In an exemplary embodiment, the panels are attached to one or more hinge mounts rotatable on at least one axis supported by and horizontally disposed within the support. In an embodiment, a mount comprises at least one hinge member comprising a stationary member connected to the apparatus support, a movable member and a hinge pin interconnecting the stationary and movable members. In an exemplary embodiment, the support may comprise a hinge mount mounting member unobstructively horizontally spanning across the support passage to opposed sides of the support proximate the bottom opening, and the stationary member may be connected to the hinge support member. Each panel has a proximal and distal portion, and each moveable hinge member attaches to the proximal portions of each panel. By unobstructively is meant that the hinge mount mounting member does not block movement of air though the passage.

In an exemplary embodiment a beam unobstructively horizontally spans across the support passage and connects to opposed sides of the support proximate the top opening. By unobstructively is meant that the beam does not block movement of air though the passage. In an embodiment such opposing sides are the same as the sides to which the hinge mount mounting member spans, and the beam and the hinge mount mounting member are centered in the passage. In an embodiment a plurality of straps connects the hinge mounting member to the beam.

In mentioned embodiments in which a beam unobstructively horizontally spanning across said passage, the upright over-the-center home position of the panels tucks the panels under the beam free from casual pedestrian view through the atmospheric opening covered by a grate over the opening. The panels may lean inwardly against a vertical member suspended from the beam. The rotation of each panel downwardly to a passage closing position is by active human intervention acting to move each panel away from the over-the-center home position to a position past the center point of the pivot axis, letting the panel then fall under the force of gravity. This movement of a panel away from the over-the-center home position may be accomplished by insertion of a tool though a grating to push or pull a panel. In an alternative exemplary embodiment, a moveable member is included mounted inside the support higher than the pivot axis and is manipulatable by human action to move the one or more panels past the center point of the pivot axis to allow the one or more panels to gravitationally rotate downwardly to the passage closing position. In one exemplary embodiment, a vertical member against which a panel leans may comprise the moveable member. In an exemplary embodiment the moveable member is vertically slideable in the beam and have a lateral dimension in the direction of the panels such that on vertical retraction toward the beam the depth of the lateral dimension is enough to push the one or more panels past the mid-point of the pivot axis. In another exemplary embodiment, the moveable member is mounted in the beam for horizontal rotation and has a lateral length such that on rotation the length suffices to push the one or more panels past the center point of the pivot axis to allow the one or more panels to gravitationally rotate downwardly to the passage closing position.

In the descriptions of exemplary embodiments that follow, the passage closing position is one in which the panel or panels are horizontal. The concept of the invention is not limited to this disposition. Stops for stopping panel lowering may be positioned to stop the downward travel above horizontal and still close a ventilation passage. The described embodiments are only illustrative of examples in which the concepts of the invention may be implemented.

Referring now particularly to FIGS. 1-8, they show an exemplary embodiment of an apparatus for preventing downward flow of surface water into an underground ventilation duct fluidly communicating through a ventilation shaft to a rectilinear atmospheric opening of the shaft. Referring to FIGS. 1-5B initially, the apparatus exemplary embodiment comprises a support embodied in a four-sided box 210 inclusive of sidewalls 224 (224*a*, 224*b*, 224*c*, 224*d*) having at the upper extent of the sidewalls flanges 220 (220*a*, 220*b*, 220*c*, 220*d*) transverse to the sidewalls 224 for extension over a top of walls of a ventilation shaft for suspension of box 210 vertically in the shaft to define a passage 225 between top opening 226 and bottom opening 228 of box 210 for fluid communication of a ventilation duct up through box 210 to an atmospheric opening at top opening 226. U-shaped channels or brackets 211*a*, 211*c* are formed in the upper sides of opposing sidewalls 224*a* and 224*c* respectively. The apparatus shown is suitable as a drop in solution to seal vent passages from storm waters by lowering it into a ventilation shaft to rest on walls of the shaft. In place, a grate (not pictured in FIGS. 1-7) covers top opening 226. In normal operation, operator access to the interior of box 210 is through the grate.

Although an exemplary embodiment as described herein employs a four sided box support 210, some locations may allow use of a support in the shape of a hollow cylinder also having stops 230 proximate a bottom opening of the support, and this form is comprehended within the scope of the invention.

As best seen variously in FIGS. 4-7, stops 230*a*, 230*b*, 230*c* and 230*d* in the form of corner braces in box 210 are within and connected to sidewalls 224 proximate bottom opening 228 and do not obstruct passage 225. Adjacent sidewalls include a base 227 having rounded corners 227*a*, 227*d* above respective stops 230*a*, 230*d*, and a base 229 having rounded corners 229*b* and 229*c* above respective stops 230*b*, 230*c*. Rounded corners 227*a*, 227*d* and 229*b*, 229*c* have a round corner radius of curvature.

Referring variously to FIGS. 1-3 and 6-8, a beam 242 comprising extruded tubing unobstructively horizontally spans across passage 225 and connects to opposed sidewalls 224*a*, 224*c* of box 210 proximate top opening 226. Beam 242 is lodged in U-shaped brackets 211*a*, 211*c*, conveniently lowered into brackets 211*a*, 211*c* by operators holding beam foldable handles 212*a*, 212*c*. Beam 242 and straps 244 described below comprise a suspension member for equipment described below. Beam 242 and its attached equipment can be lowered into place as a complete unit 201 after box 210 is installed in ventilation shaft resting on flanges 220. Unit 201 can be removed from box 210 for servicing by withdrawing beam 242 from brackets 211*a*, 211*c* by means of handles 212*a*, 212*c*.

Although an embodiment as described employs a suspension member comprising a beam 242 and straps 244 for supporting equipment described below, the scope of the invention is not limited to such embodiment. A suspension member may be employed other than beam 242 and straps 244, for example a suspension member can be a vertical solid or fenestrated plate. An advantage of the described beam 242 and straps 244 embodiment is a lighter weight imposing a lesser load on flanges 220 than a solid plate, but a fenestrated plate would serve a lighter load advantage as well albeit likely more costly.

Referring particularly to FIGS. 1, 3, and 6-8, a hinge mounting member 245 unobstructively horizontally spans across passage 225 connected by a plurality of straps 244*a*, 244*b*, 244*c*, 244*d* to beam 242. Lodged in U-brackets 211*a* and 211*c*, beam 242 and hinge mounting member 245 spanning between sidewalls 224*a*, 224*c* are centered in passage 225 of box 210 with beam 242 directly over hinge mounting member 245.

Hinge mounting member 245 mounts and supports a plurality of hinge members 243. Hinge members 243 each comprise a stationary member 243*b*, a movable member 243*a* and a hinge pin 243*c* that interconnects stationary member 243*b* and movable member 243*a*. Stationary member 243*b* connects to hinge mounting member 245.

Figure 6:
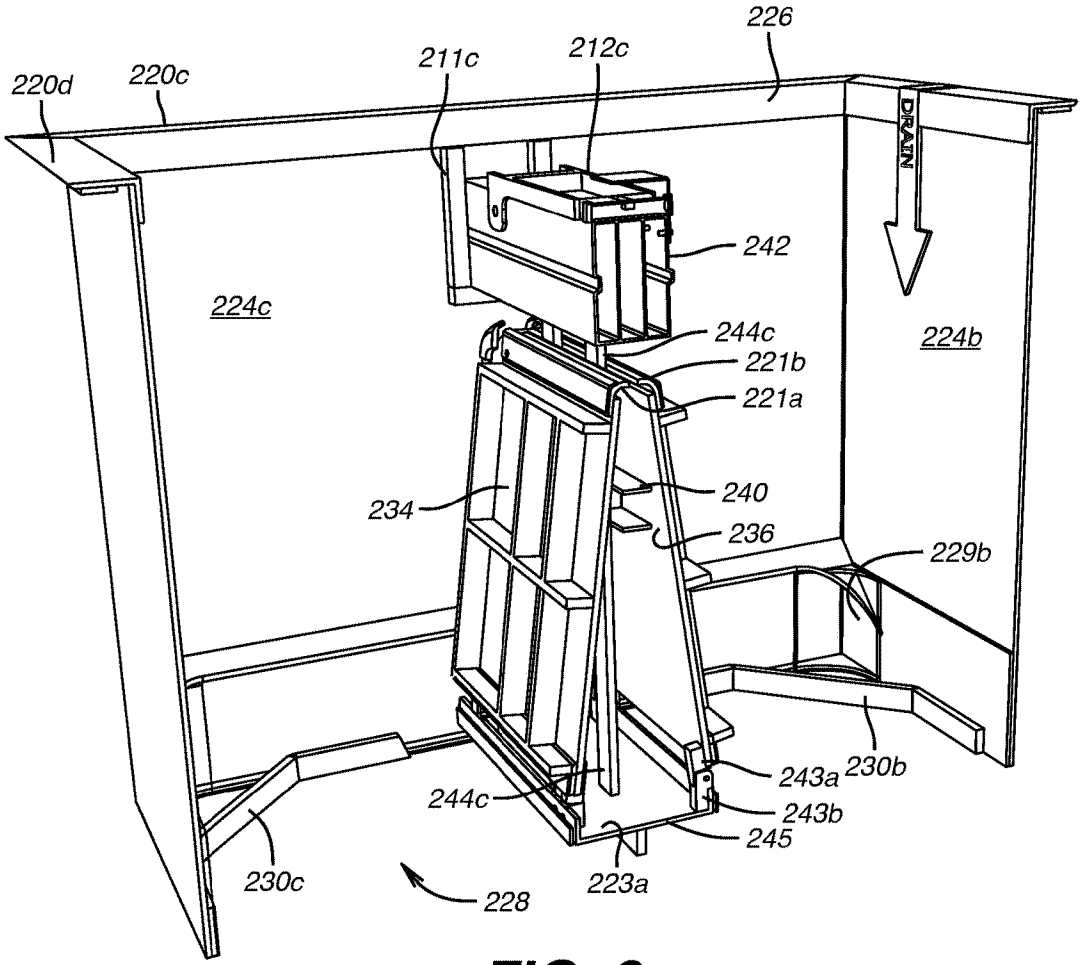
FIG. 6 is a fragmental sectional perspective view of an exemplary embodiment of the panel apparatus of this invention.

A pair of opposing panels 234, 236 each having proximal and distal portions, respectively 234*a*, 234*b* and 236*a*, 236*b*, are connected at proximal portions 234*a*, 236*a* by moveable hinge members 243*a* to stationary hinge members 243*b* and thereby to hinge mounting member 245 and from hinge mounting member 245 via straps 244*a*, 244*b*, 244*c*, 244*d* to beam 242. The connection of moveable hinge members 243*a* to the proximal portions 234*a*, 236*a* of panels 234, 236 on hinge pins 243*c* forms respective pivot axes of panels 234, 236 for vertical rotation of panels 234, 236. Panels 234, 236 rotate in directions opposite each other from or to an upright home position under beam 242. Rotation of the panels upwardly (one clockwise, the other counterclockwise) is effected manually by human action raising each panel so the panels 234, 236 pass over a center point of the pivot axis, in the embodiment, over the center point of hinge pins 243*c*, to an upright inwardly leaning over-the-center home position. In the depicted exemplary embodiments in FIGS. 1-3 and 6-8, panels lean in against a moveable box 240 suspended by a rod 246 that is vertically slideably and/or laterally rotatably mounted in a passageway through beam 242, terminating above beam 242 in a T-handle 252 optionally shielded by a cover 253. FIG. 6 is a fragmentary sectional perspective view in which the section is taken just to the viewer's side of rod 246, such that box 240 is seen in section in front of strap 244*c*. Moveable box 240 may have a fore-aft lateral dimension or depth facing the panels such that on lifting T-handle 252 to retract box 240 toward beam 242, the depth suffices to push the distal end 234*b*, 236*b* of panels 234, 236 outwardly past the center point of the pivot axis 243*c* of the respective hinges for panels 234, 236, causing the panels 234, 236 to gravitationally rotate downwardly to stops 230 and close passage 225. Alternatively, moveable box 240 may have a lateral dimension or length such that on turning T-handle 252 to horizontally rotate box 240, the length suffices to push the distal end 234*b*, 236*b* of panels 234, 236 outwardly past the center point of the pivot axis 243*c* of the respective hinges for panels 234, 236, causing the panels 234, 236 to gravitationally rotate downwardly to stops 230 and close passage 225. Alternatively, the absence of box 240, rod 246 and T-handle 252, a tool may be inserted from above though an opening in the beam to push or pull a panel away from straps 244 enough to move the distal end 234*b*, 236*b* of panels 234, 236 outwardly past the center point of the pivot axis pin 243*c* of the respective hinges for panels 234, 236, causing the panels 234, 236 to gravitationally rotate downwardly to stops 230 and close passage 225.

Each panel has a profile that closes the passage when the panels gravitationally rotate to the passage closing position. The distal portions of the panels have rounded corners 219 with a radius of curvature substantially the same as the radius of curvature of the sidewall corners 229*a*, 229*b*, 229*c* and 229*d* they sweep when rotating to the passage closing position. The panels include peripheral distal and lateral seals 221, 222 for sealing the passage in the passage closing position, seals 221*a*, 222*a* for panel 234 and seals 221*b*, 222*b* for panel 236. A gasket seal 223 (223*a* for panel 234, 223*b* for panel 236) spans the proximal ends of bases of panels 234, 236 below pin 243*c* and seals bottom opening 228 at the proximal ends of panels 234, 236 when the panels are in the passage closing position.

Panels 234, 236 are provided with structure to raise the panels manually to home position 213. Each panel 234, 236 has a handle 259, 259' on its top side remote from the pivot axes of pins 243*c* of the hinge members 243 to which the proximate ends 234*a*, 236*a* of the panels 234, 236 are connected. A tool such as hooking tool can be used by an operator and inserted through a grate over box 210 to grasp handle 259, 259' to lift panel 234, 236.

Figure 7:
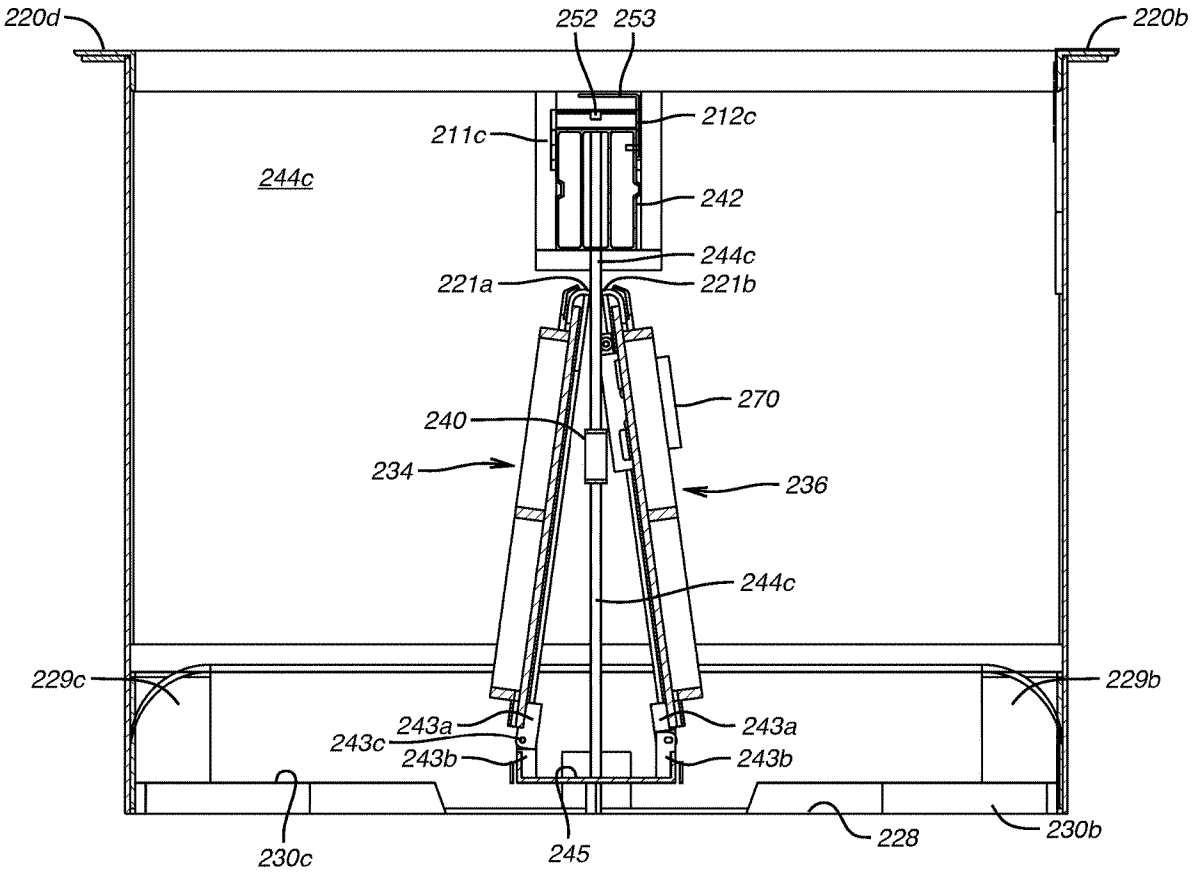
FIG. 7 is a cross sectional view of the embodiment of FIG. 6.
Figure 8:
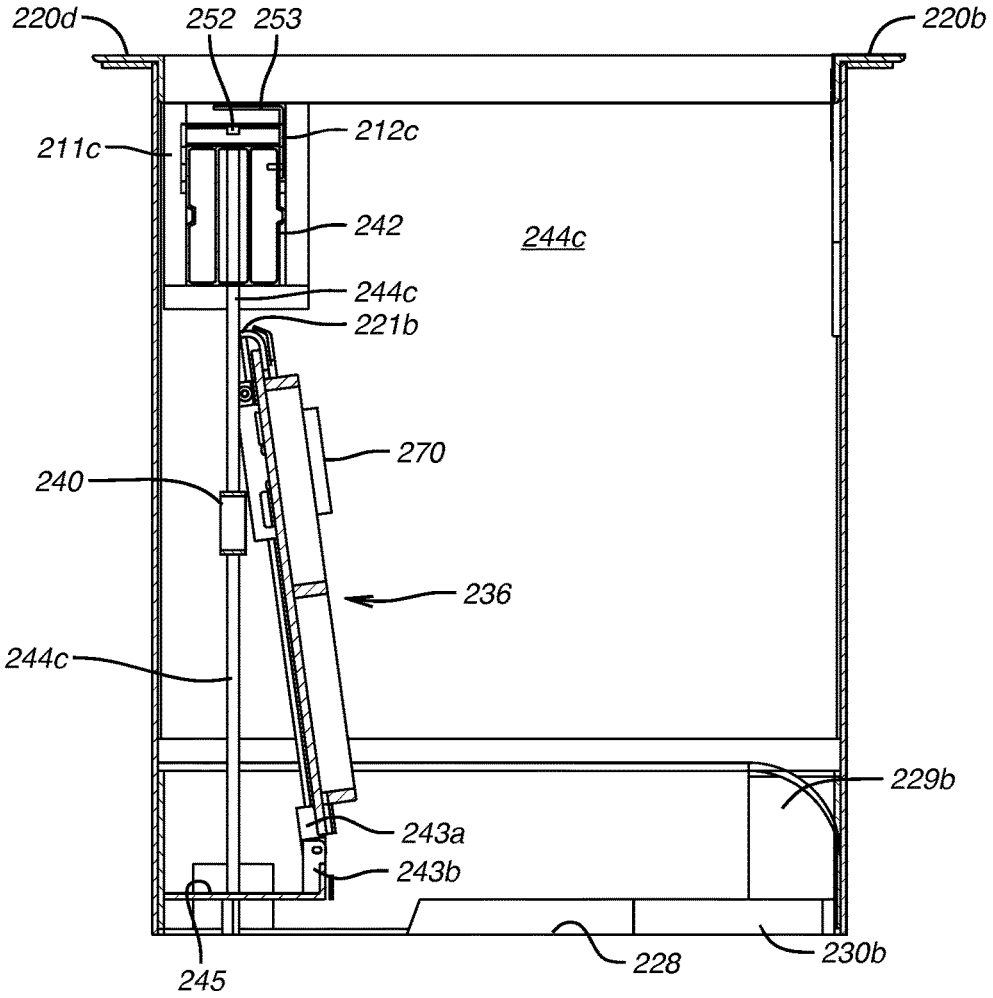
FIG. 8 is a cross sectional view of a single panel embodiment of this invention.

At least one of the panels, such as panel 236 as seen in FIGS. 7, 8 may be fitted with a drain 270 intermediate the proximate and distal ends of the panel.

As depicted in FIGS. 2, 4A, 5A and 6, box support 210 has a single indicator 285 on one sidewall 224*d* adjacent the opposed lateral sidewalls 224*a*, 224*c* and two indicators 286, 287 on the facing sidewall 224*b*. The indicators are labeled to point where certain structure is located below the indicator. The purpose of the labeled indicators 285, 286, 287 is to tell a worker where to insert a reach tool through a grating covering the support 210 to find and manipulate the structure indicated by the label on the indicator.

Having described illustrative examples of embodiments that incorporate concepts of the invention, those skilled in the art will be able to use these concepts as guided by these embodiments, and may form alternative variations that nonetheless embrace the concepts herein disclosed and still be within the scope of my invention as claimed in the claims that follow.

The invention claimed is:

1. An apparatus for allowing ventilation through a ventilation shaft to an underground ventilation duct fluidly communicating through the ventilation shaft to an atmospheric opening of the shaft and on threat of flooding operable to prevent downward flow of surface water into the underground ventilation duct, comprising: a support for arrangement in said shaft defining a passage between top and bottom openings of the support for fluid communication of said ventilation duct up through said support to said atmospheric opening, one or more stops within and connected to said support proximate said bottom opening and not obstructing said passage, and one or more panels mounted on a pivot axis in said support for rotation of each said panel upwardly by human action raising each said panel past a center point of the pivot axis to an upright inwardly leaning home position in said support, said home position not obstructing said passage, and for rotation downwardly by human action moving each said panel away from said home position outwardly past said center point of said pivot axis, allowing each said panel to rotationally fall by gravitational impetus to a lower passage closing position where further downward rotation is prevented by said one or more stops, each said panel having a profile such that said one or more panels closes said passage when said panels gravitationally rotate to said passage closing position.

2. The apparatus of claim 1 wherein a panel is mounted to a side of said passage.

3. The apparatus of claim 1 comprising a pair of panels mounted on opposite sides of said passage.

4. The apparatus of claim 1 comprising a pair of panels mounted centrally in said passage for rotation of the panels in directions opposite each other from or to said upright home position not obstructing said passage, in gravitational rotation falling from said upright home position to said lower passage closing position.

5. The apparatus of claim 4 comprising at least one hinge mount comprising a stationary member, a movable member and a hinge pin interconnecting the stationary and movable members, said stationary member being connected to said support, each one or more panels having a proximal and distal portion, each said moveable hinge member attaching to said proximal portions of said one or more panels.

6. The apparatus of claim 5 comprising a hinge mount mounting member unobstructively horizontally spanning across said passage and supported between opposed sides of said support proximate said bottom opening, and a beam unobstructively horizontally spanning across said passage and connected to opposed sides of said support proximate said top opening, such opposing sides being the same as the sides between which said hinge mount mounting member spans.

7. The apparatus of claim 6 comprising a plurality of straps connecting said hinge mount mounting member to said beam.

8. The apparatus of claim 4 in which a closable and reopenable drain is provided in at least one of the panels.

9. The apparatus of claim 4 in which the panels have a handle on an atmospheric opening facing surface for raising the panels to said home position.

10. The apparatus of claim 1 further comprising a moveable member mounted inside said support higher than said axis and manipulatable by human action to move said one or panels past said center point of said pivot axis to allow the one or more panels to gravitationally rotate downwardly to said passage closing position.

11. The apparatus of claim 10 in which said one or more panels in said upright inwardly leaning home position leans against a vertical member in said support.

12. The apparatus of claim 11 in which said vertical member comprises said moveable member.

13. The apparatus of claim 10 comprising a suspension member unobstructively horizontally spanning across said passage and connected to opposed sides of said support proximate said top opening and in which said moveable member extends below said suspension member.

14. The apparatus of claim 13 in which said moveable member has a lateral dimension in the direction of said one or more panels such that retraction of said moveable member toward said suspension member suffices to push said one or more panels past said center point of said pivot axis to allow the one or more panels to gravitationally rotate downwardly to said passage closing position.

15. The apparatus of claim 13 in which said moveable member has a lateral length such that horizontal rotation of the moveable member suffices to push said one or more panels past said center point of said pivot axis to allow the one or more panels to gravitationally rotate downwardly to said passage closing position.

16. The apparatus of claim 1 in which said shaft is vertical, said atmospheric opening is rectilinear, and said support comprises a four-sided box inclusive of sidewalls sized to internally fit in said shaft between said ventilation duct and said atmospheric opening, said support further comprising flanges transverse to said sidewalls for overlaying a top of said shaft to hang said support in said shaft.

17. The apparatus of claim 16 in which each said one or more panels has a proximal and distal portion, and said sidewalls include a base having rounded corners with a first radius of curvature and in which said distal portions of said panels have rounded corners with a radius of curvature substantially the same as said first radius of curvature of the sidewall corners they sweep when rotating to said passage closing position.

18. The apparatus of claim 17 in which said panels include seals for sealing said passage in said passage closing position.

19. The apparatus of claim 1 in which each said one or more panels is hingedly rotatable on at least one said pivot axis supported by and horizontally disposed within said support.

20. An apparatus for allowing ventilation through a ventilation shaft to an underground ventilation duct fluidly communicating through the ventilation shaft to an atmospheric opening of the shaft and on threat of flooding operable to prevent downward flow of surface water into the underground ventilation duct, comprising: a support for arrangement in said shaft defining a passage between top and bottom openings of the support for fluid communication of said ventilation duct up through said support to said atmospheric opening, one or more stops within and connected to said support proximate said bottom opening and not obstructing said passage, and a pair of panels centrally mounted in said passage on a pivot axis in said support for rotation of each said panel upwardly by human action raising each said panel past a center point of the pivot axis to an upright inwardly leaning home position in said support, said home position not obstructing said passage, and for rotation downwardly by human action manipulating a moveable member mounted inside said support higher than said axis to move each said panel away from said home position outwardly past said center point of said pivot axis, allowing each said panel to rotationally fall by gravitational impetus to a lower passage closing position where further downward rotation is prevented by said one or more stops, each said panel having a profile such that said one or more panels closes said passage when said panels gravitationally rotate to said passage closing position.

* * * * *